US011226595B2

(12) United States Patent
Wiederrecht et al.

(10) Patent No.: US 11,226,595 B2
(45) Date of Patent: Jan. 18, 2022

(54) COUPLING SYSTEM FOR A CHRONOGRAPH

(71) Applicant: NOGERAH SA, Meyrin (CH)

(72) Inventors: Jean-Marc Wiederrecht, Bernex (CH); Laurent Wiederrecht, Onex (CH); Maximilien Di Blasi, St-Genis Pouilly (FR); Guy Dubois-Ferrière, St-Cergues (FR)

(73) Assignee: NOGERAH SA, Meyrin (CH)

( * ) Notice: Subject to any disclaimer, the term of this patent is extended or adjusted under 35 U.S.C. 154(b) by 440 days.

(21) Appl. No.: 16/461,017

(22) PCT Filed: Nov. 14, 2017

(86) PCT No.: PCT/EP2017/079223
§ 371 (c)(1),
(2) Date: May 15, 2019

(87) PCT Pub. No.: WO2018/091476
PCT Pub. Date: May 24, 2018

(65) Prior Publication Data
US 2019/0271952 A1 Sep. 5, 2019

(51) Int. Cl.
*G04F 7/08* (2006.01)

(52) U.S. Cl.
CPC ..... *G04F 7/0828* (2013.01); *G04F 7/0804* (2013.01)

(58) Field of Classification Search
CPC ..... G04F 7/08; G04F 7/0804; G04F 7/0823; G04F 7/0828
See application file for complete search history.

(56) References Cited

U.S. PATENT DOCUMENTS 5,113,382 A * 5/1992 Bron ..... G04F 7/0814 368/106
5,220,541 A * 6/1993 Vuilleumier ..... G04F 7/0814 368/110
6,761,478 B2 * 7/2004 Schmiedchen ..... G04F 7/0814 368/101

(Continued)

FOREIGN PATENT DOCUMENTS

EP 2251747 11/2010

*Primary Examiner* — Edwin A. Leon
*Assistant Examiner* — Jason M Collins
(74) *Attorney, Agent, or Firm* — Duane Morris LLP; Gregory M. Lefkowitz

(57) ABSTRACT

A coupling system for a chronograph mechanism is presented. The system can include an input wheel intended to be driven by a drive member; an output wheel intended to drive at least one display member; an intermediate wheel continuously kinematically connected to the input wheel or the output wheel, where the intermediate wheel changes between a coupled state where the input wheel is kinematically connected to the output wheel and an uncoupled state where the kinematic connection is broken. The system also includes a first friction wheel constrained to rotate with the intermediate wheel and a second friction wheel constrained to rotate with either the input wheel and the output wheel; a first safety wheel constrained to rotate with said intermediate wheel that includes a first set of safety teeth; and a second safety wheel constrained to rotate with the second wheel that includes a second set of safety teeth.

20 Claims, 3 Drawing Sheets

(56) References Cited

U.S. PATENT DOCUMENTS

2004/0066711 A1* 4/2004 Haefeli ..... G04F 7/0828
368/101
2017/0068223 A1 3/2017 Kruttli et al.

* cited by examiner

COUPLING SYSTEM FOR A CHRONOGRAPH

CROSS-REFERENCE TO RELATED APPLICATIONS

This application is a § 371 national stage entry of International Application No. PCT/EP2017/079223, filed Nov. 14, 2017, which claims priority of European National Application No. 16199425.6 (EP), filed Nov. 17, 2016, the entire contents of which are incorporated herein by reference.

TECHNICAL FIELD

The present invention relates to the field of clockmaking. It concerns, more particularly, a coupling system for a chronograph mechanism.

PRIOR ART

The coupling systems commonly used in chronographs are typically of two types, namely horizontal couplings and vertical couplings.

In a horizontal coupling, an intermediate wheel is mounted to pivot in the plane of the movement in order to connect kinematically a driving input wheel and a driven output wheel. The input wheel is typically the face gear, constrained to rotate with the seconds wheel of the clock movement, and the output wheel is typically the chronograph wheel, constrained to rotate with the seconds hand of the chronograph.

As a function of the angular position of a lever that carries the intermediate wheel, the input wheel and the output wheel are kinematically connected (coupled state), or this connection is broken because the intermediate wheel is out of reach of the output wheel (uncoupled state). The position of the lever is typically controlled by means of a column wheel, a shuttle, a cam or a similar control means.

This kind of coupling is of small thickness and enables construction of relatively thin chronograph mechanisms. However, since the intermediate wheel and the output wheel each carry a set of teeth, the necessary tolerances for the correct operation of the coupling generate backlash. This backlash can generate trembling of the associated display member, in the absence of other compensating measures such as the deliberate introduction of friction into the system, for example by means of a friction spring. Moreover, there exists a risk of the summit of a tooth of the intermediate wheel coming into contact with a flank of a tooth of the output wheel when the coupling is brought into its coupled state, the result of which is that the seconds hand of the chronograph jumps a certain angle in one direction or the other at the moment of starting the chronograph.

In order to minimize the probability of this jump occurring and to reduce its amplitude if it does occur, the intermediate wheel typically includes a set of pointed triangular teeth, the output wheel also including the same type of teeth, but even finer. The pitch of the teeth of the output wheel is usually half or one third of that of the intermediate wheel, for example.

In order to prevent the seconds hand of the chronograph being able to jump in the unwanted manner as described above, the vertical coupling has been proposed. In this type of coupling the kinematic connection between the input and output wheels is effected by means of a pair of friction disks that are coaxial and that are subjected to a return force tending to bring one of their plane faces into contact with each other. In the coupled state, the torque is transmitted between the input wheel and the output wheel by the friction between these friction disks. This kinematic connection by friction eliminates any backlash of the clutch.

To break the kinematic connection and to stop the chronograph a gripper, typically controlled by a column wheel, enables the friction disks to be separated by means of wedge surfaces that are disposed between said disks. By withdrawing these wedges, the friction disks fall back one onto the other and the kinematic connection is re-established.

Because there is no penetration of one set of teeth into another at the moment of actuation of the vertical coupling, any unwanted jumping of the seconds hand of the chronograph is prevented. However, this kind of vertical coupling necessitates a great deal of space within the height of the mechanism in order to arrange a plurality of toothed wheels, the friction disks and their return springs in a coaxial manner. In order to overcome these disadvantages, the document EP1437633 has proposed a horizontal coupling that attempts to prevent any unwanted jumping, in which the sets of teeth of the intermediate wheel and of the output wheel are conformed so that contact between the summit of a tooth of the intermediate wheel and the inactive flank of the output wheel is mathematically impossible. In fact, in the worst case scenario, i.e. when the summits of two teeth come directly into contact during coupling, the inactive flanks of the teeth of the output wheel follow the epicyclic trajectory of the summit of a tooth of the intermediate wheel. Consequently, it is in theory impossible for activation of the coupling to generate an unwanted backward jump of the output wheel. For reference, the documents EP2251747 and WO2015/173372 also disclose the same tooth shape.

However, this solution necessitates that the shape of the teeth, as well as the adjustment of the mechanism be mathematically quasi-perfect, which is difficult to control during production. Moreover, any wear of the intermediate wheel and/or of the output wheel will degrade this perfect shape, and thus the risk of unwanted jumping will increase over time. However, this solution makes no contribution to solving the problem of the trembling mentioned hereinabove, because in practise a tolerance must still be present to ensure a functional interaction between the sets of teeth of the coupling. To this end the introduction of friction into the system, for example by means of a friction spring, remains necessary.

The document EP2085832 proposes another variant of a horizontal coupling preventing any trembling and any unwanted jumping, in which the torque is transmitted between the input wheel and the output wheel by means of three elastic arms extending from a hub toward a cylindrical friction surface. When the ends of these elastic arms bear against this cylindrical surface, which is the internal wall of a hollow cylinder, the transmission of torque between the hub and said surface is assured by friction, which eliminates any backlash. In order to decouple the coupling, the ends of the elastic arms are fitted with pins that extend perpendicularly to the arms and that assume a position in cam paths formed in a control wheel. By pivoting this control wheel relative to the elastic arms in a first direction, the ends of the latter can be moved away from said cylindrical surface, and return into contact with the latter when the control wheel pivots in the direction opposite the first direction.

This structure is very complex, however, and is not compatible with standard movements, thus necessitating a dedicated structure.

The object of the invention is consequently to propose a coupling system for a chronograph in which the disadvantages mentioned above are at least partially overcome.

DISCLOSURE OF THE INVENTION

To be more precise, the invention concerns a coupling system for a chronograph mechanism, as defined by the independent claim. That system comprises an input wheel intended to be driven by a motor unit, such as a barrel, a motor or the like, an output wheel intended to drive at least one display member such as a chronograph seconds hand, and an intermediate wheel.

That intermediate wheel is permanently kinematically connected to a first wheel chosen from said input wheel and said output wheel, typically the input wheel, but the converse arrangement is equally possible. The intermediate wheel is mounted so that it can evolve between a coupling state in which said input wheel is kinematically connected to said output wheel and the chronograph operates and an uncoupled state in which said kinematic connection is broken and the chronograph is stopped.

According to the invention, the coupling further includes a first friction wheel constrained to rotate with said intermediate wheel and a second friction wheel constrained to rotate with a second wheel chosen from said input wheel and said output wheel, that second wheel being the wheel opposite said first wheel, thus typically the output wheel. These friction wheels are at least partially coplanar, i.e. they are at least partially located in the same plane, and are adapted to transmit rotation between said intermediate wheel and said second wheel, or vice versa depending on the arrangement chosen, when said intermediate wheel, and therefore said coupling system, is in the coupled state.

The coupling further includes a first safety wheel constrained to rotate with the intermediate wheel, which comprises a first set of safety teeth and a second safety wheel constrained to rotate with said second wheel, which comprises a second set of safety teeth. These sets of safety teeth are conformed in order mutually to interpenetrate when said intermediate wheel is in the coupled state.

Because the rotation between the intermediate wheel and the second wheel is effected by friction between the friction wheels rather than by meshing sets of teeth, no trembling of the output wheel (and therefore of an associated indicator member) is produced when starting the chronograph. Moreover, because the overall construction reprises that of a conventional horizontal coupling, the coupling system according to the invention can be easily integrated into a standard movement, with no (or little) modification.

The intermediate wheel is advantageously mounted to pivot on a lever controlled by an elastic element. The use of an elastic element to control the lever enables predetermination and therefore optimization of the contact force between the friction wheels.

The elastic element is advantageously carried by a control lever that may, for example, be controlled by a control member such as a column wheel, a shuttle or a cam, and that includes abutments adapted to prevent the intermediate wheel (and therefore the coupling system) from changing state in the event of an impact. The control lever therefore defines a limit on movement of the intermediate wheel in each of its states, which prevents unwanted angular movements of the output wheel in the uncoupled state and prevents breaking of the kinematic connection when the intermediate wheel is in the coupled state.

The elastic element advantageously comprises a free end that interacts with said lever in order to control it, said abutments being situated on respective opposite sides of the free end. Consequently, in the event of an impact, the free end of the elastic member, which may take the form of a fork for example, comes into contact with one of these abutments. Thus a simple and compact arrangement is proposed.

One of said abutments is advantageously adapted to prevent said intermediate wheel and said second wheel interacting in the event of an impact when said intermediate wheel is in its uncoupled state, the other of said abutments being adapted to prevent said sets of safety teeth being able to move out of reach of one another in the event of an impact when said system is in its coupled state.

The system may further comprise an intermediate gear wheel meshing on the one hand with said first wheel and on the other hand with said intermediate wheel. This intermediate gear wheel may, where appropriate, comprise a set of play compensation teeth.

The sets of safety teeth advantageously each comprise teeth having a maximum width of one quarter, preferably a maximum width of one fifth, of the pitch of said set of teeth, as measured at the maximum depth of interpenetration of said sets of safety teeth. This reduces the probability that the sets of teeth abut against one another on starting the chronograph, and the magnitude of the jump, if there has to be one, is minimized since the safety teeth are relatively fine.

Said first wheel may be said input wheel and said second wheel may be said output wheel. In this case the upstream flanks of the first safety wheel and the downstream flanks of the second safety wheel are advantageously curved. Consequently, in the event that a tooth of the first safety wheel abuts against a tooth of the second safety wheel, a slight additional acceleration of the second wheel may occur before the kinematic connection by friction is established. This acceleration is less visible to a user than a jump. In the converse situation, i.e. if the first wheel is the output wheel and the second wheel is the input wheel, the upstream flanks of the second safety wheel and the downstream flanks of the first safety wheel may be curved with the same effect.

The invention also relates to a clock movement comprising a chronograph mechanism provided with a coupling system as described hereinabove and a timepiece comprising this kind of movement.

BRIEF DESCRIPTION OF THE DRAWINGS

Other details of the invention will become more clearly apparent on reading the following description given with reference to the appended drawings, in which.

EMBODIMENT OF THE INVENTION

Figure 1:
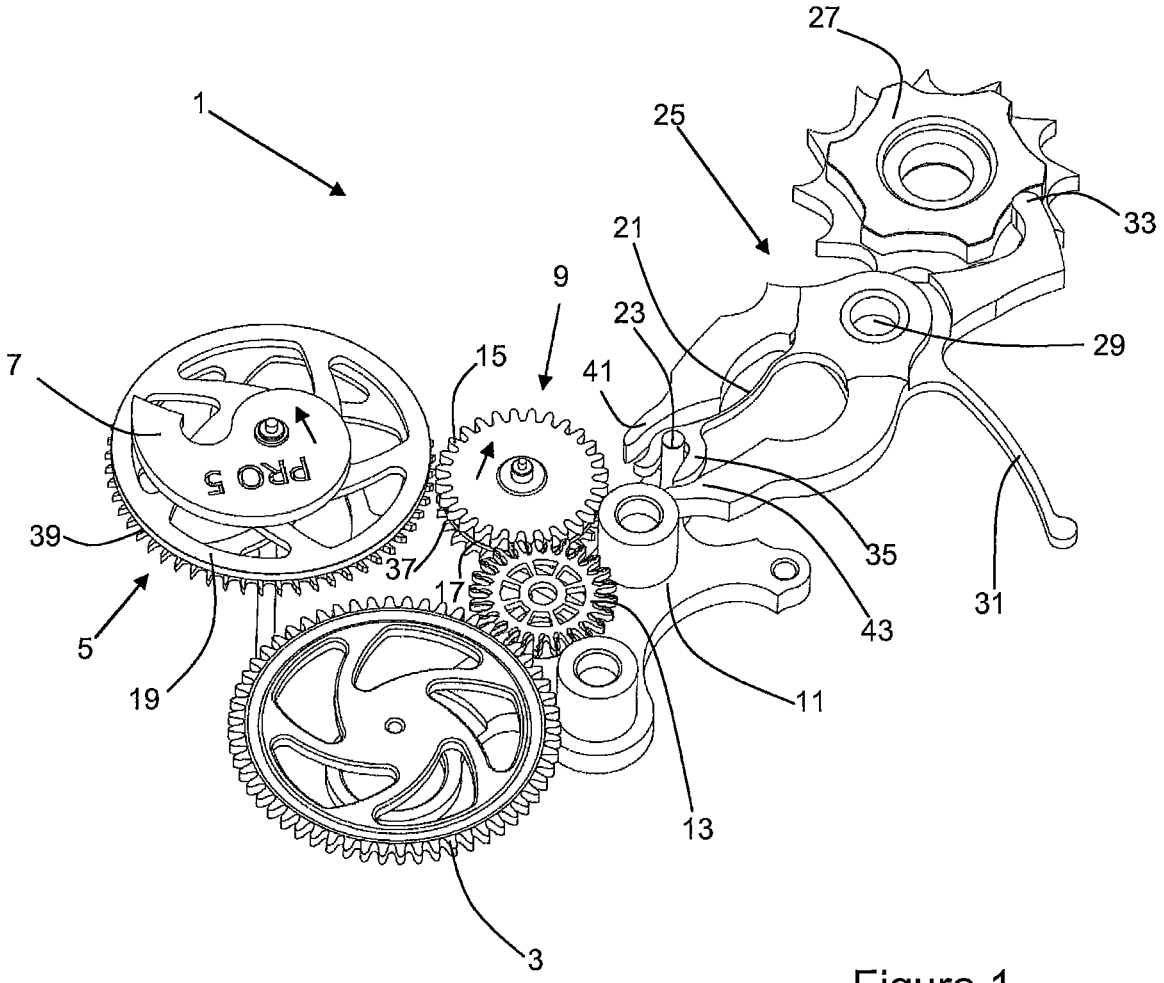
FIG. 1 is an isometric view of a coupling system according to the invention in the uncoupled state.
Figure 2:
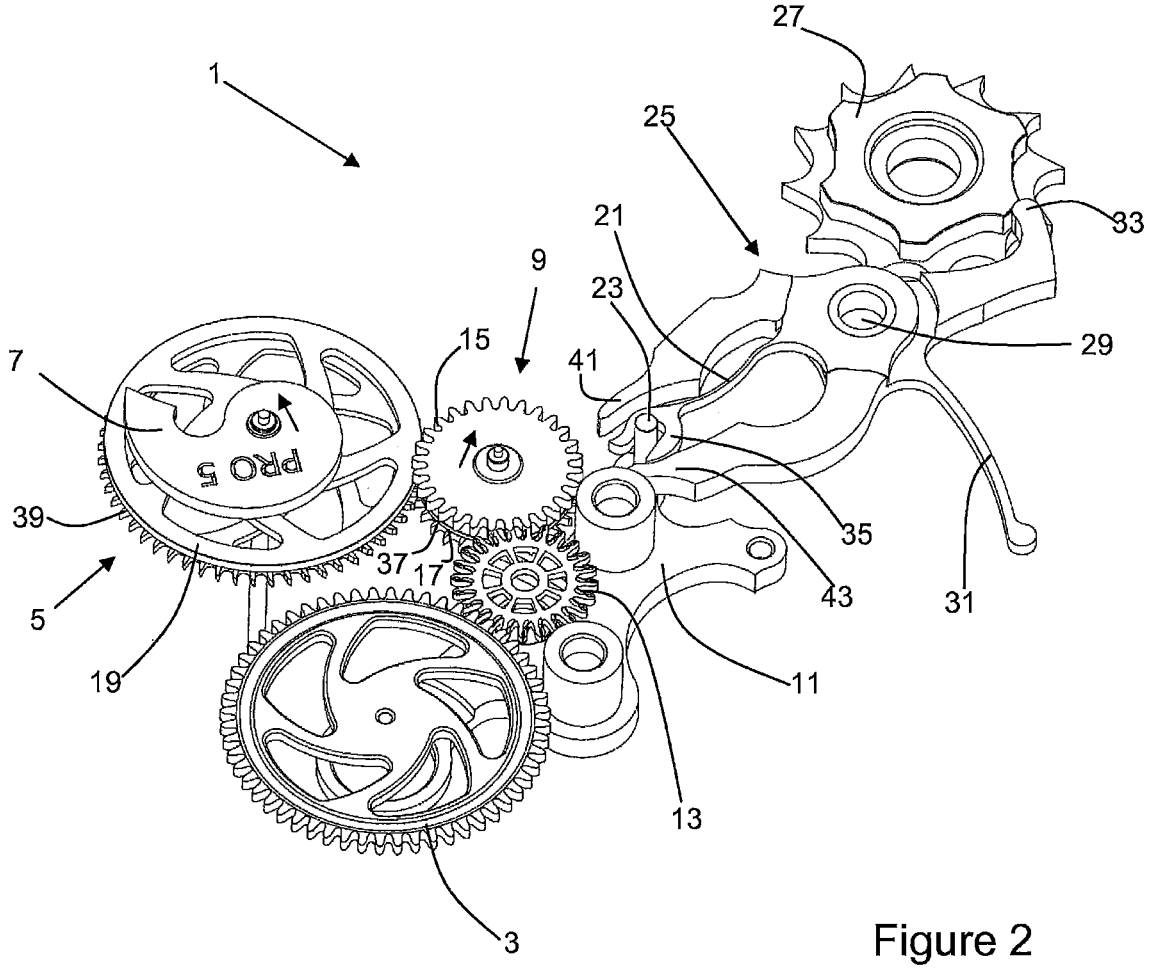
FIG. 2 is an isometric view of the coupling system from FIG. 1 in the coupled state.

FIGS. 1 and 2 show a coupling system 1 according to the invention for a chronograph in an uncoupled, respectively coupled state.

As is widely known, the horizontal type system 1 comprises an input wheel 3, adapted to be driven by a base movement (not shown) included in the timepiece in which the system 1 is integrated. The input wheel 3 may, for example, be constrained to rotate with the seconds wheel of said movement, or driven by the latter. Alternatively, another appropriate wheel may be used for the same purpose.

The input wheel 3 is kinematically connected selectively with an output wheel 5, which in this instance is a seconds wheel of the chronograph, and which also carries a reset to zero cam 7.

This selective kinematic coupling is effected by the intervention of a first intermediate wheel 9 mounted to rotate freely on a lever 11 and permanently kinematically connected to the input wheel 3. This lever 11 also carries an intermediate gear wheel 13 that meshes continuously on the one hand with the input wheel 3 and on the other hand with a set of teeth 15 of the intermediate wheel 9. Pivoting of the lever can establish or break a kinematic connection between the first intermediate wheel 9 and the output wheel 5. The coupled, respectively uncoupled state of the intermediate wheel 9 therefore determines the corresponding state of the coupling system 1.

Alternatively, in an opposite construction, the first intermediate wheel 9 may be continuously kinematically connected to the output wheel 5 by means of the intermediate gear wheel 13 in an analogous manner to the first variant, pivoting of the lever thus kinematically connecting the first intermediate wheel 9 and the input wheel. The following description deals with the first of these variants, as shown in the figures; the modifications for implementing the second variant will be evident to the person skilled in the art and do not need to be described in detail.

In the embodiment shown, the intermediate gear wheel 13 comprises a set of play compensation split teeth, but a conventional wheel is equally possible. It may equally be envisaged to provide only one intermediate wheel 9, which therefore meshes directly with the input wheel 3.

The lever 11 is mounted to pivot about the same rotation axis as the input wheel, but a slight offset between the rotation axes of these components is permissible.

In order to drive the output wheel 5 when the system 1 is in the coupled state, the intermediate wheel 9 includes a first friction wheel 17 that is adapted to come into contact with a second friction wheel 19 of the output wheel 5. The materials and the finish (presence of layers, roughness, etc.) of the friction wheels may be chosen according to the requirements of the clockmaker to provide the transmission of torque with an appropriate contact force.

This contact force is produced by an elastic element 21 that also controls the lever 11, as will become more clearly apparent hereinafter.

The elastic element 21 is a leaf spring carried by a control lever 25 mounted to rotate about a rotation axis 29 and subjected to a return force by means of a return elastic element 31 that tends to cause it to pivot in the anticlockwise direction (in the orientation shown in the figures) and thus to maintain its tail 33 in contact with the column wheel 27. The latter controls the control lever 25 in the conventional manner. Alternatively, the control lever 25 may be controlled by a system with a shuttle or a cam or a similar system.

The free end of the elastic element 21 includes a fork 35 that interacts with a tenon 23 situated at an end at a distance from the pivot axis 29 of the control lever 25. When the control lever 25 pivots in the clockwise direction under the control of the column wheel 27, the elastic element applies a force that causes the lever 11 to pivot in the anticlockwise direction. The friction wheels 17, 19 consequently come into contact with one another and the input wheel 3 is therefore kinematically connected to the output wheel 5 (see FIG. 2). The elastic element 21 provides the force necessary for maintaining the friction wheels 17, 19 in contact with one another and to generate the radial force necessary to provide correct transmission of torque with no slippage.

Starting from the orientation of the components shown in FIG. 2, when the column wheel 27 pivots by one step, the return elastic member 31 causes the control lever 25 to pivot in the anticlockwise direction and the elastic element 21 causes the lever 11 to pivot so that the first friction wheel 17 is moved away from the second friction wheel 19. The components therefore revert to their position shown in FIG. 1 and the kinematic connection between the input wheel 3 and the output wheel 5 is broken.

Compared to the force necessary to maintain the meshing between the sets of teeth of the intermediate wheel and of the output wheel in a conventional horizontal coupling, that produced by the elastic element 21 of the present invention is relatively low.

In order to render the system 1 insensitive to impacts despite the relatively low force exerted between the friction wheels 17, 19, a number of arrangements are provided.

Figure 3:
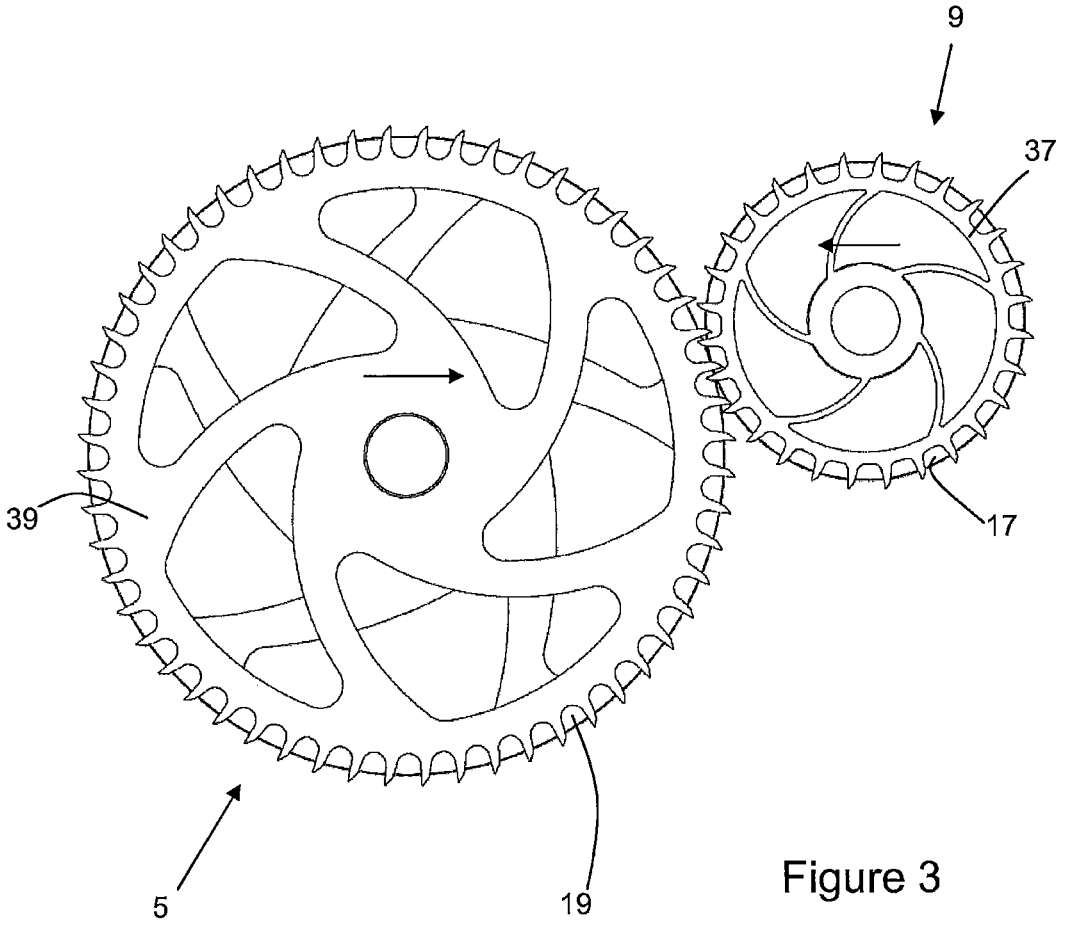
FIG. 3 is a view of the intermediate wheel and the output wheel of the system from FIG. 1, seen from below relative to the FIG. 1 orientation.

Firstly, at the level of the intermediate wheel 9 and the output wheel 5, respective safety wheels 37, 39 are provided. These safety wheels 37, 39 are shown to a larger scale in FIG. 3, in which their orientation is reversed relative to that of FIGS. 1 and 2.

A first safety wheel 37 comprising a first set of safety teeth is constrained to rotate with the intermediate wheel 9 and a second safety wheel 39 comprising a second set of safety teeth is constrained to rotate with the output wheel 5. These sets of teeth are conformed so that, in normal operation of the coupling, they do not come into contact with one another. There is therefore no meshing between these wheels 37, 39 and they do not contribute to the transmission of torque between the intermediate wheel 9 and the output wheel 5 during normal operation of the coupling system 1.

In this regard, when the coupling is in the uncoupled state (see FIG. 1), these sets of teeth are out of reach of one another. When the coupling is in the coupled state (see FIGS. 2 and 3), the teeth of the sets of teeth interpenetrate and are within reach of one another.

In the event of an impact that displaces the output wheel 5 angularly relative to the intermediate wheel 9, the sets of safety teeth interact in order to limit that angular displacement. This displacement is therefore limited to the angle travelled until a tooth of the first set of safety teeth comes into contact with a tooth of the second set of safety teeth. The pitch of these teeth being small, the user will not notice this slight displacement of the seconds hand of the chronograph.

The shape of the teeth of the sets of safety teeth is also particular because the teeth do not participate in the transmission of torque and serve only as abutments in the event of an impact. In fact, during normal operation of the system 1, they do not mesh in the usual meaning of that term, because they interpenetrate freely and without contact or transmission of torque. The teeth are consequently relatively thin compared to their length. In the variant shown in the figures the width of the teeth is substantially one quarter of the pitch of said set of teeth, as measured at the maximum depth of interpenetration.

The summits of the teeth are pointed and asymmetrical; considering the first safety wheel 37, the downstream faces of its teeth are substantially radially oriented, whereas the upstream faces of said teeth feature a curvature. The teeth of the second safety wheel 39 have the opposite shape so that if the sets of teeth come into abutment in the operating rotation direction the respective flanks with the greatest curvature interact, the respective flanks with the least curvature interacting in the event of an impact driving rotation of the output wheel in the contrary direction.

The small width of the teeth minimizes the probability of the sets of teeth interacting during coupling of the system 1 and minimizes the jump if it occurs. Moreover, the asymmetrical shape chosen for the safety teeth favors a forward "jump". In the event of this kind of interaction the curved upstream face of one tooth slides on the curved face of the other tooth until the friction wheels 17, 19 act again to drive the output wheel 5. At the moment of starting the chronograph, this interaction of the sets of safety teeth generates a small momentary and interceptible acceleration of the second hands of the chronograph and not a visible jump. A perceptible unwanted jump is therefore eliminated. It should be noted here that the "inactive" flanks of the teeth in the sense of the patent EP1437633, i.e. the downstream flanks of the teeth of the first safety wheel 37 and the upstream flanks of the teeth of the second safety wheel, are steeply sloped and extend in an essentially radial direction. However, other shapes of the sets of teeth are equally possible.

The elastic element 21 is relatively weak so as to be able to absorb any manufacturing imperfections such as out-of-rounds, inaccurate positions of the pivots, etc. and to minimize the stresses exerted on the latter. The first friction wheel 17 is therefore pressed less strongly against the second friction wheel 19 than with conventional sets of teeth and consequently there also exists a risk that an impact can displace the lever 11 angularly from its normal position. Without the provision of the safety means described hereinabove, this displacement could for example momentarily interrupt the kinematic connection in the coupled state or could create a transitory kinematic connection between the intermediate wheel 9 and the output wheel 5 in the uncoupled state of the coupling.

In order to prevent this risk, the control lever 25 also includes a first safety arm 41 and a second safety arm 43 situated on respective opposite sides of the fork 35 at the end of the elastic element. These safety arms 41, 43 are constrained to rotate with the control lever 25 and each serves as an abutment for the fork 35 in the event of an impact.

The first safety arm 41 is positioned and shaped so that, in the uncoupled state (FIG. 1), it is impossible for the teeth of the first safety wheel 37 to be within reach of those of the second safety wheel 39. In other words, the fork 3 abuts against the first safety arm before these teeth can interact.

In the same way, the second safety arm 43 is positioned and shaped so that, in the coupled state (FIG. 2), it is impossible for the teeth of the two safety wheels 37, 39 to move out of reach of one another. In this case, the delay of the seconds hand generated by an impact breaking the kinematic connection is limited to the arc travelled until a tooth of the first safety wheel abuts against a tooth of the second safety wheel. Then, a fraction of a second later, the friction wheels 17, 19 will re-establish their kinematic connection because of the effect of the elastic element 21 and the driving of the output wheel 5 by continuous friction as described hereinabove.

In this kind of situation, although the seconds indicator of the chronograph has been shifted by a fraction of a second one way or the other, it is unlikely that the user will notice it following the impact.

Although the invention has been described in connection with one particular embodiment, variations are possible without departing from the scope of the invention as defined by the appended claims.

What is claimed is:

1. A coupling system for a chronograph mechanism, said system comprising:

an input wheel intended to be driven by a drive member;

an output wheel intended to drive at least one display member;

an intermediate wheel continuously kinematically connected to a first wheel chosen from said input wheel and said output wheel, said intermediate wheel being mounted so that it can change between a coupled state in which said input wheel is kinematically connected to said output wheel and an uncoupled state in which said kinematic connection is broken;

wherein said system further includes:

a first friction wheel constrained to rotate with said intermediate wheel and a second friction wheel constrained to rotate with a second wheel chosen from said input wheel and said output wheel, said friction wheels being at least partially coplanar and being adapted to transmit rotation between said intermediate wheel and said second wheel, or vice versa, when said system is in the coupled state;

a first safety wheel constrained to rotate with said intermediate wheel and comprising a first set of safety teeth and a second safety wheel constrained to rotate with said second wheel and comprising a second set of safety teeth, said sets of safety teeth being conformed in order to interpenetrate mutually when said intermediate wheel is in the coupled state.

2. The system as claimed in claim 1, in which said intermediate wheel is mounted to pivot on a lever controlled by an elastic element.

3. The system as claimed in claim 2, in which said elastic element is carried by a control lever including abutments adapted to prevent said intermediate wheel from changing state in the event of an impact.

4. The system as claimed in claim 3, in which said elastic element comprises a free end that is adapted to interact with said lever, said abutments being situated on respective opposite sides of said free end.

5. The system as claimed in claim 4, in which one of said abutments is adapted to prevent said intermediate wheel and said second wheel being able to interact in the event of an impact when said intermediate wheel is in its coupled state, the other of said abutments being adapted to prevent said sets of safety teeth being able to move out of reach of one another in the event of an impact when said intermediate wheel is in its coupled state.

6. The system as claimed in claim 5, further comprising an intermediate gear wheel meshing on the one hand with said first wheel and on the other hand with said intermediate wheel.

7. The system as claimed in claim 3, in which one of said abutments is adapted to prevent said intermediate wheel and said second wheel being able to interact in the event of an impact when said intermediate wheel is in its coupled state, the other of said abutments being adapted to prevent said sets of safety teeth being able to move out of reach of one another in the event of an impact when said intermediate wheel is in its coupled state.

8. The system as claimed in claim 3, further comprising an intermediate gear wheel meshing on the one hand with said first wheel and on the other hand with said intermediate wheel.

9. The system as claimed in claim 3, in which said sets of safety teeth each comprise teeth having a width of at most one quarter of the pitch of said set of teeth as measured at the maximum depth of interpenetration of said safety teeth.

10. A timepiece movement comprising a chronograph mechanism provided with a coupling system as claimed in claim 3.

11. The system as claimed in claim 2, further comprising an intermediate gear wheel meshing on the one hand with said first wheel and on the other hand with said intermediate wheel.

12. The system as claimed in claim 2, in which said sets of safety teeth each comprise teeth having a width of at most one quarter of the pitch of said set of teeth as measured at the maximum depth of interpenetration of said safety teeth.

13. A timepiece movement comprising a chronograph mechanism provided with a coupling system as claimed in claim 2.

14. The system as claimed in claim 1, further comprising an intermediate gear wheel meshing on the one hand with said first wheel and on the other hand with said intermediate wheel.

15. The system as claimed in claim 14, in which said intermediate gear wheel comprises a set of play compensation teeth.

16. The system as claimed in claim 1, in which said sets of safety teeth each comprise teeth having a width of at most one quarter of the pitch of said set of teeth as measured at the maximum depth of interpenetration of said safety teeth.

17. The system as claimed in claim 1, in which said first wheel is said input wheel and said second wheel is said output wheel.

18. The system as claimed in claim 17, in which upstream flanks of the first safety wheel and downstream flanks of the second safety wheel are curved.

19. A timepiece movement comprising a chronograph mechanism provided with a coupling system as claimed in claim 1.

20. A timepiece comprising a movement as claimed in claim 19.

* * * * *